United States Patent [19]

Harada et al.

[11] Patent Number: 4,577,673

[45] **Date of Patent: * Mar. 25, 1986**

[54] GUIDE ROLL

[75] Inventors: Shinichi Harada, Kobe; Yoshinobu Ishihara, Takatsuki; Shigeru Matsushita, Nishinomiya, all of Japan

[73] Assignee: Kabushiki Kaisha Kobe Seiko Sho, Kobe, Japan

[ * ] Notice: The portion of the term of this patent subsequent to Mar. 25, 2003 has been disclaimed.

[21] Appl. No.: 513,092

[22] Filed: Jul. 12, 1983

[30] Foreign Application Priority Data

Jul. 13, 1982 [JP] Japan ..... 57-105888[U]
Jul. 13, 1982 [JP] Japan ..... 57-105887[U]
Aug. 2, 1982 [JP] Japan ..... 57-118098[U]

[51] Int. Cl.[4] ..... B22D 11/12
[52] U.S. Cl. ..... 164/448; 164/442; 29/124
[58] Field of Search ..... 164/447, 448, 441, 442, 164/423, 428, 463, 480; 29/124

[56] References Cited

U.S. PATENT DOCUMENTS 2,770,082 11/1956 Whitesell ..... 29/124 X
4,040,158 8/1977 Payne ..... 29/125 X

FOREIGN PATENT DOCUMENTS 56-114562 2/1980 Japan .

*Primary Examiner*—Nicholas P. Godici
*Attorney, Agent, or Firm*—Oblon, Fisher, Spivak, McClelland & Maier

[57] ABSTRACT

A guide roll of the type which is provided with a ceramic sleeve around the circumference of a steel roll shaft with an internal cooling water passage, the guide roll including a cylindrical ceramic sleeve constituted by a multitude of discrete ceramic segments assembled into a number of annular unitary rings fitted around the circumference and along the length of the roll shaft, the individual ceramic segments being mounted in a restricted state at least in radial and circumferential directions of the roll shaft; and end plates securely fixed to the opposite ends of the roll shaft to grippingly hold the respective unit rings in an axially abutted state on the circumference of the roll shaft.

14 Claims, 14 Drawing Figures

GUIDE ROLL

BACKGROUND OF THE INVENTION

1. Field of the Invention

This invention relates to guide rolls, and, more particularly, to a guide roll construction suitable for conveying hot workpieces, for example, in continuous metal casting operations, ingot-making operations or in an anterior stage of hot rolling in the steel-making industry or the like.

2. Description of the Prior Art

Conventional guide rolls of this sort are generally constituted by a steel roll shaft of unitary construction to ensure necessary strength and are internally provided with a cooling water passage for enhancing the heat resistance of the roll shaft. In some cases, for the purpose of increasing the thermal resistance, there have been used guide rolls with a heat resistance alloy surface or guide rolls of a composite construction having a sleeve or rings of heat resistant material integrally fitted on the circumference of the roll shaft. However, the conventional integrated type roll constructions are more or less unsatisfactory in heat resistance, in resistance to thermal shocks, in resistance to abrasive wear and mechanical strength which are essential for the guide rolls to be used for guiding workpieces of high temperature, in the absence of a unitary or composite material which can meet all of these requirements.

Further, in the continuous casting processes, there is an increasing trend toward energy conservation, retaining the heat of the hot cast stock while it is transferred after severing and utilizing its heat effectively in the subsequently hot rolling. In the continuous casting operation, the rolls which convey a continuously cast strip from a water-cooled mold to a shearing machine are subjected to a high temperature above 1000° C. so that more severe conditions are imposed on this sort of guide rolls. In order to lessen thermal deterioration in strength which will shorten the service life of the rolls and to reduce the heat dissipation from the workpieces to the rolls, it has been proposed to use ceramic material with high heat resistance and a high heat insulating property, e.g., embedding the ceramic material in axial or circumferential grooves provided on the outer periphery of a roll shaft, or fixing pieces of a ceramic material on the circumference of a heat insulating cylinder which is fixedly fitted on the roll shaft. However, the conventional guide rolls of this sort invariably are complicated in construction or require complicated machining operations on the steel roll shaft itself or on the mounting pieces which fix the ceramic material on the roll shaft, coupled with problems such as the short service life of the mounting pieces due to thermal fatigue resulting from the exposure to the heat of the high temperature work and difficulty in repairing the rolls or replacing damaged ceramic material in a short time period.

SUMMARY OF THE INVENTION

It is therefore an object of the present invention to overcome the above-mentioned drawbacks or problems of the conventional guide rolls.

It is a more particular object of the present invention to provide a guide roll suitable for conveying a workpiece of high temperature, having on a roll shaft a cylindrical ceramic sleeve consisting of a multitude of discrete ceramic segments axially slidably fitted on the circumference of the roll shaft.

It is another object of the present invention to provide a guide roll of the nature mentioned above, having on the circumference of a roll shaft a cylindrical ceramic sleeve constituted by a number of axially aligned unitary rings each consisting of discrete ceramic segments fitted around the circumference of the roll shaft and axially slidable independently of each other or in groups.

It is a further object of the present invention to provide a guide roll of the class mentioned above, in which the rings are unitarily mounted on an outer cylinder fitted axially slidably on the core cylinder of the roll shaft and divided into a number of sections in the axial direction.

It is still another object of the present invention to provide a guide roll of intermediate support construction employing a pair of juxtaposed partial roll shafts each having an internal water cooling passage and a ceramic sleeve as mentioned above.

According to a fundamental aspect of the present invention, there is provided a guide roll of the type which is provided with a ceramic sleeve around the circumference of a steel roll shaft with an internal cooling water passage, the guide roll comprising a cylindrical ceramic sleeve constituted by a multitude of discrete ceramic segments assembled into a number of annular rings unitarily fitted around the circumference and along the length of the roll shaft, the individual ceramic segments being mounted in a restricted state at least in radial and circumferential directions of the roll shaft; and end plates securely fixed to the opposite ends of the roll shaft to grippingly hold the respective rings in an axially abutted state on the circumference of the roll shaft.

The above and other objects, features and advantages of the present invention will become apparent from the following description and the appended claims, taken in conjunction with the accompanying drawings which show by way of example some illustrative embodiments of the present invention.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
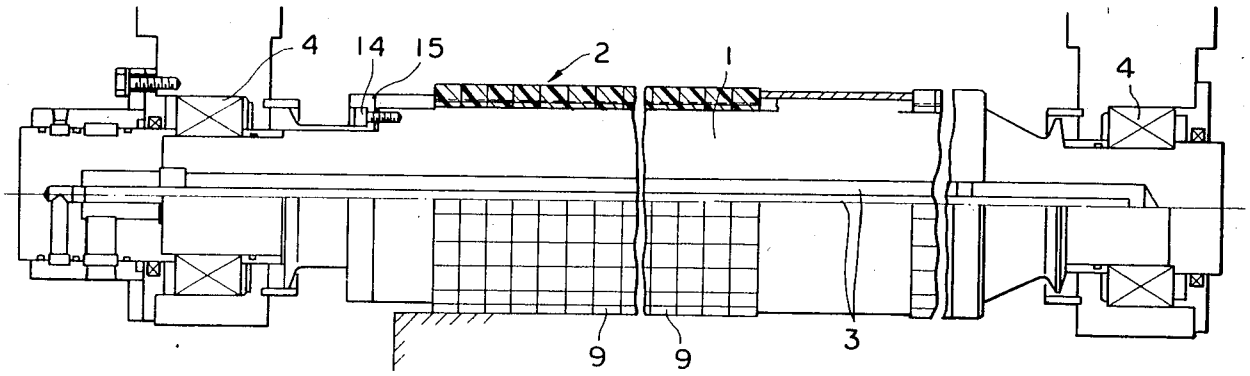
FIG. 1 is a schematic longitudinal sectional view of a guide roll embodying the present invention.
Figure 2:
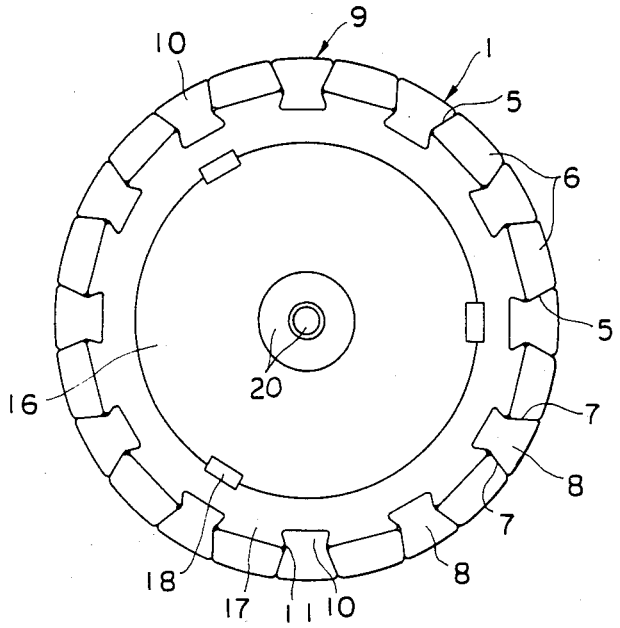
FIG. 2 is a transversely sectioned end view of the guide roll.
Figure 3:
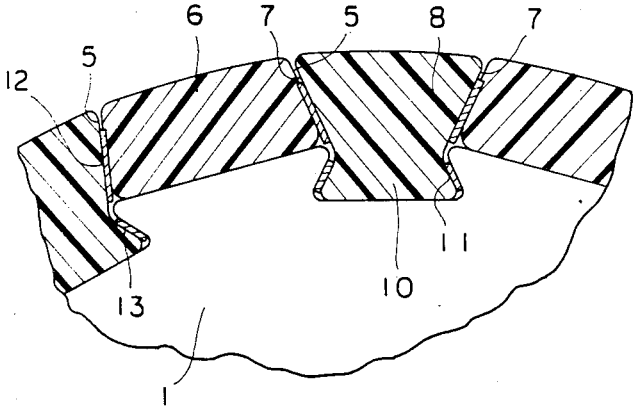
FIG. 3 is a fragmentary enlarged view of ceramic segments fitted on the circumference of the guide roll.

Referring now to the accompanying drawings and first to FIGS. 1 to 3, there is shown a fundamental guide roll construction according to the present invention, which essentially consists of a steel roll shaft 1 and a ceramic sleeve 2 which is assembled around the circumference of the roll shaft 1. The steel roll shaft 1 is axially provided with a cooling water passage 3 for circulating cooling water therethrough, and journalled in bearings 4 at the opposite ends thereof. The ceramic sleeve 2 is constituted by an assemblage of a multitude of discrete ceramic segments.

As illustrated in FIGS. 2 and 3, the ceramic segments consists of two kinds of segments, namely, first segments 6 of a trapezoidal shape with side projections 5 of an obtuse angle, and second segments 8 with recesses 7 of an obtuse angle on the radially opposite lateral sides which faces the lateral projections of the adjacent first segments 6. The first and second ceramic segments 6 and 8 are positioned side by side and alternately around the circumference of the roll shaft 1 so that the lateral projections 5 of each first segment 6 are abutted snugly in the recesses 7 of the obtuse angle on the radially lateral sides of the adjacent second segments 8, assembling them into an annular unit ring 9. A number of such annular unit rings 9 are abutted end to end in the axial direction to form the ceramic sleeve 2 coextensive with the roll shaft 1. In the embodiment shown in FIGS. 1 to 3, the second segments 8 of the respective rings are aligned in the axial direction and have the respective radially laterally projected dovetail leg portions 10 fitted in dovetail grooves 11 which are provided axially on the circumference of the roll shaft 1. Shims 12 and 13 are inserted between the abutting radially lateral sides of the first and second segments 6 and 8 and between the abutting radially lateral sides of the leg portions 10 and the side walls of the dove-tail grooves 11, respectively, to thereby absorb fluttering motions of the segments 6 and 8 rather than simply to fill gaps or spaces.

The ceramic segments 6 and 8 which are fitted on the steel roll shaft 1 are slid in the axial direction thereof to form a required number of rings 9 along the length of the roll shaft 1. The assembled rings 9 of the ceramic segments 6 and 8 are axially abutted against the adjacent segments and held in position by an end plate 15 which is fixed to the end of the roll shaft 1 by bolts 14. To facilitate the assembly of a multitude of ceramic segments 6 and 8, the roll shaft 1 is constituted by a core cylinder 16 with a cooling water passages 20 and an outer cylinder 17. Wherein the dovetail grooves 11 are fitted on the core cylinder 16 axially through outer cylinder 17 and keys 18 as shown in FIG. 2 axially displaceable relative to the core shaft. The roll shaft 1 is divided into a number of sections in the axial direction.

With the foregoing guide roll construction according to the present invention, the second segments 8 are restricted and held in position by the dovetail grooves 11 of the roll shaft 1 while the first segments 6 are restricted by the adjacent second segments 8 which are located on opposite sides of the first segments 6. The guide roll is simple in construction and does not require any special fixing means for assembling and mounting the ceramic segments 6 and 8. Deterioration in the strength of the guide roll is prevented by water cooling of the roll shaft 1 and the ceramic sleeve 2 which covers the roll shaft 1 to prevent direct contact with the heat of casting. The engaging radially lateral sides of the segments 6 and 8 are formed with obtuse angles so that they can ensure a sufficient strength even at the fitted leg portions. Further, the guide roll construction of the invention has an advantage in that the roll shaft 1 does not require complicated machining operations for mounting the ceramic sleeve 2, coupled with the reduction of cost by the use of ceramic segments which can be easily assembled and disassembled.

Figure 5:
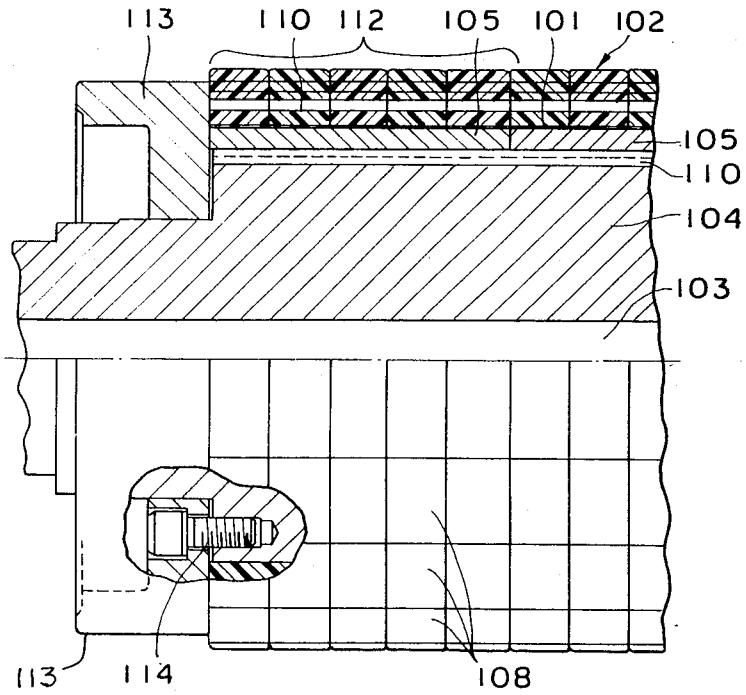
FIG. 5 is a fragmentary longitudinal sectional view of the embodiment of FIG. 4.
Figure 4:
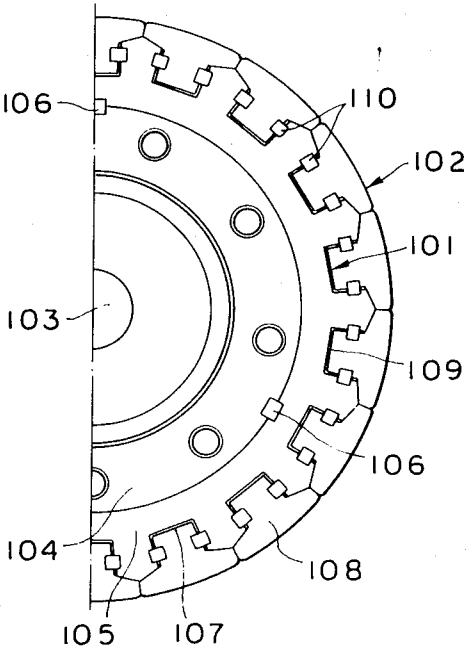
FIG. 4 is a fragmentary cross sectional view of another embodiment of the present invention.

Referring to FIG. 4, there is shown another embodiment of the invention, wherein the ceramic sleeve 102 is constituted by a multitude of ceramic segments 108 of the same kind which are assembled cylindrically around the circumference of a roll shaft 101 and similarly including a core cylinder 104 with an axial cooling water passage 103 and an outer cylinder 105. In this case, each ceramic segment 108 has sectoral end faces and a leg portion 109 which is fitted in an axial groove 107 on the circumference of the outer cylinder 105 through short keys 110 of a length as will be described hereinafter, to thereby block the displacement of the segment 108 in the radial and circumferential directions while permitting its displacement in the axial direction. The ceramic segments 108 are firstly positioned side by side around the circumference of the outer cylinder 105 to form an annular unit ring, for example, five rings are unitarily connected in the axial direction as shown in FIG. 5 into a ceramic sleeve block 112 and mounted on the outer cylinder 105 through the short keys 110 coextensive with the outer cylinder 105. Then, a number of sleeve blocks 112 are connected in the axial direction to form the ceramic sleeve 102. Similarly to the foregoing embodiment, the ceramic sleeve 102 is fixed in position on the steel roll shaft 101 by an end plate 113 which is securely fixed to the core shaft 104 by bolts 114.

In the event a certain ceramic segment or segments are damaged when the guide roll is in service, the sleeve block 112 which contains the damaged segment in the axial direction and instead a spare sleeve block is mounted on the guide roll, permitting complete replacement of damaged ceramic segments in a short time period. In the meantime, the dismantled sleeve block 112 which contains a damaged segment is disassembled outside the production line and, after replacing the damaged segment, it is assembled again to prepare for its next use.

Figure 7:
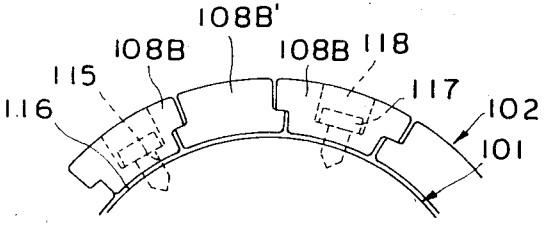
FIG. 7 is a fragmentary end view of a ring unit constituted by ceramic segments with wing-like lateral projections.
Figure 6:
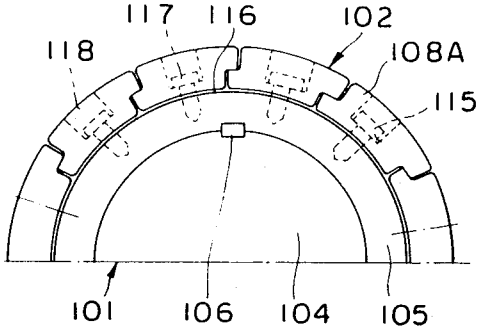
FIG. 6 is a view similar to FIG. 4 but showing a ceramic sleeve employing ceramic segments of a different shape.
Figure 8:
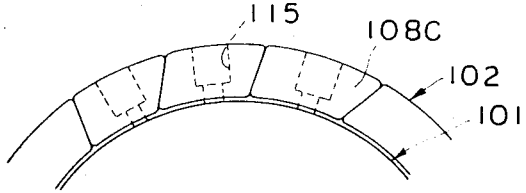
FIG. 8 is a view similar to FIG. 7 but showing a ring unit constituted by ceramic segments with inclined surfaces on radially lateral sides thereof.
Figure 11:
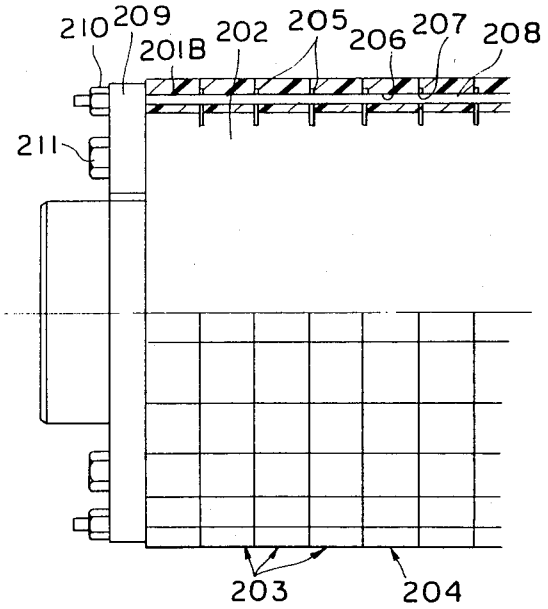
FIGS. 10 and 11 are a cross sectional view and a fragmentary longitudinal sectional view of another embodiment of the invention.
Figure 10:
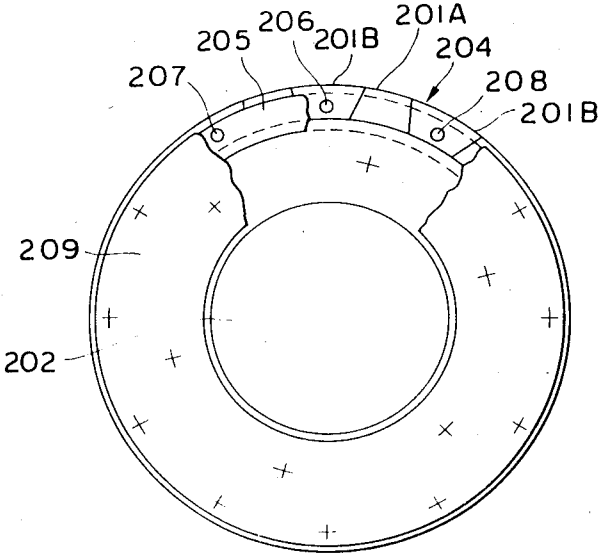

FIGS. 6 to 8 illustrate further embodiments of the present invention, employing segments of different shapes and constructions. More specifically the embodiment of FIG. 6 employs ceramic segments 108A which are each provided with staggered upper and lower projections extending in the circumferential direction in an end view and with a mounting hole 115. Each ceramic segment 108A is fixedly mounted on the circumference of the steel roll shaft 101 by a bolt 117 which is threaded into an outer cylinder 105 of the roll shaft through the mounting hole 115 and a heat insulator 116 which is interposed between the ceramic segment 108A and the circumference 105 of the steel roll shaft 101. The sunken head of the bolt 117 is located in the mounting hole 115.

In the embodiment shown in FIG. 7, a ceramic segment 108B with wing-like lateral projections on the upper side and a ceramic segment 108B' with wing-like radially lateral projections on the lower side are alternately positioned around the circumference of the roll shaft to form a ring. In this case, the respective ceramic segments are fixed in position by fixing only the ceramic segments 108B with the lateral projections on the upper side to the outer cylinder 105 by means of bolts 117 since the segments 108B' are restricted by the adjacent segments 108B. In this instance, the number of ceramic segments to be bolted to the roll shaft is reduced as compared with the embodiment of FIGS. 4 and 5.

FIG. 8 shows a ceramic sleeve 102 which consists of a number of rings of ceramic segments 108C with inclined side surfaces and respectively secured to the roll shaft by bolts 115. With this segment arrangement, it is possible to replace a damaged ceramic segment or segments independently of the remaining segment or segments.

Figure 9:
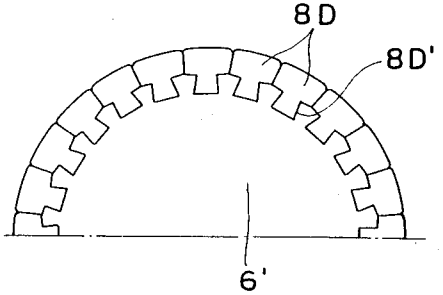
FIG. 9 is a view similar to FIG. 7 but showing a unitary ring constituted by ceramic segments with dovetail legs axially slidably fitted in dovetail grooves provided the circumference of the roll shaft.

FIG. 9 shows another example of the ceramic sleeve which employs ceramic segments 8D each having a dovetail leg portion 8D' slidably fitted in one of axial dovetail grooves on the circumference of the steel roll shaft.

Referring to FIGS. 10 to 13, there are shown further embodiments of the invention employing ceramic segments 201A, 201B which are arranged around the roll shaft 202 alternately in erect and inverted positions as indicated at 201A and 201B to form an annular unit ring 203. A number of such unit rings 203 are assembled in the axial direction of the steel roll shaft 202 to form a cylindrical ceramic sleeve 204. In the embodiment shown in FIGS. 10 and 11, the ceramic segments 201A and 201B are mounted in position by the use of support rings 205 which are inserted between the inner portions of the abutting sides of the adjacent rings 203. The support rings 205 are integrally fixed to the steel roll shaft 202 by welding or other suitable means and provided with axial bolt holes 207 in alignment with axial bolt holes 206 of inverted ceramic segments 101B. Segment set bolts 208 are inserted through the axial bolt holes 206 and 207 in the inverted segments 201B and support rings 205 and through an end plates 209 at the roll end. Nuts 210 are tightened on the threaded ends of the segment set bolts 208 to clampingly hold the segments 201B between the end plates 209 which are fixed to the steel roll shaft 201 by bolts 211. Upon fixing the inverted segments 201B, the erect segments 201A are restricted by the adjacent inverted segments 201B and held in position on the steel roll shaft.

Figure 13:
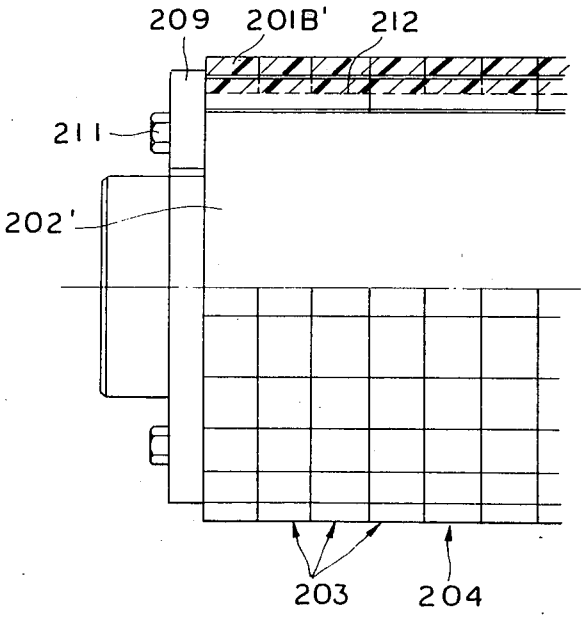
FIGS. 12 and 13 are views similar to FIGS. 10 and 11, respectively, but showing still another embodiment of the invention.
Figure 12:
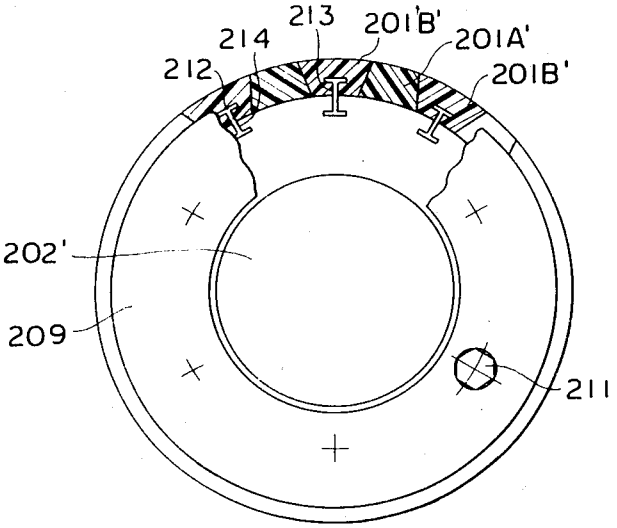

In the embodiment of FIGS. 12 and 13, mounting strips 212 of I-shape in section are used in place of the support rings 205 and segment set bolts 208. The radially outer and inner ends of the mounting strips 212 are inserted in receptacle grooves 213 and 214 which are provided axially in the bottom portions of the inverted ceramic segments 201B' and on the circumference of the steel roll shaft 202', respectively. The segments 201A' and 201B' can be removed by either extracting the I-shaped mounting strips 212 in the axial direction or axially sliding the segments 201B until they come off the mounting strips 212.

Figure 14:
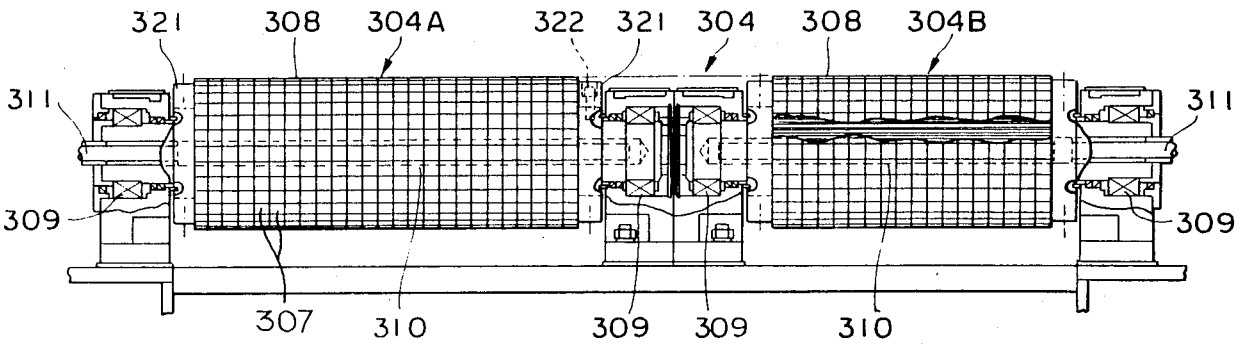
FIG. 14 is a schematic side view of a guide roll of an intermediate support construction employing a pair of juxtaposed partial rolls each being provided with the ceramic sleeve of the present invention.

Referring to FIG. 14, there is shown a guide roll 304 which is constituted by a couple of partial rolls 304A and 304B which are juxtaposed coaxially with each other. The partial rolls 304A and 304B are similarly provided with a roll shaft of ordinary steel or a low alloy steel as a support structure of sufficient strength, and a ceramic sleeve 308 consisting of a multitude of discrete ceramic segments 307 which are assembled into a cylindrical shape around the circumference of the respective roll shafts in the manner as described hereinbefore. The partial rolls 304A and 304B are respectively journalled in bearings 309 at the opposite ends, and internally cooled by cooling water which is to axial cooling water passages 310 of the roll shafts through water supply tubes 311 connected to the outer ends thereof. This intermediate support construction using a pair of partial rolls can avoid maximum stress which would be applied to the center portion in the case of a single guide roll.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A guide roll having a ceramic sleeve around a circumference of a steel roll shaft with an internal cooling water passage formed therein, said guide roll comprising:

a cylindrical ceramic sleeve including a plurality of discrete ceramic segments forming a plurality of annular rings;

means for unitarily and individually fitting each of said rings around said circumference and along the length of said roll shaft such that said ceramic segments are each restricted at least in radial and circumferential directions of said roll shaft; and first and second end plates securely fixed to opposite ends of said roll shaft for holding said rings in position on the circumference of said roll shaft wherein said roll shaft includes a plurality of axial grooves formed on the circumference thereof and said rings further comprise a plurality of said ceramic segments each having a leg portion, said ceramic segments being aligned in an axial direction and having said leg portions respectively slidably fitted in said axial grooves formed on the circumference of said roll shaft.

2. A guide roll as set forth in claim 1, further comprising a shim member interposed between the opposite lateral sides of said first ceramic segments and the opposing lateral sides of an adjacent second ceramic segments and between adjacent side walls of said leg portions of said second ceramic segments and said axial grooves in said roll shaft.

3. A guide roll as set forth in claim 1, wherein said steel roll shaft further comprises a core cylinder and an outer cylinder slidably fitted on said core cylinder and divided into a plurality of sections in an axial direction thereof.

4. A guide roll as set forth in claim 3, wherein respective sections of said plurality of sections of said outer cylinder further comprise a plurality of rings fitted around the circumference of said core cylinder.

5. A guide roll as set forth in claim 4, wherein said outer cylinder includes at least one axial groove formed on the circumference thereof and said rings further comprise ceramic segments each having radial end faces and a leg portion slidably fitted in said axial groove formed on the circumference of said outer cylinder.

6. A guide roll as set forth in claim 5, wherein said leg portion of said ceramic segment further comprises a ceramic segment axially slidably positioned in said groove of said outer cylinder.

7. A guide roll as set forth in claim 3, wherein said outer cylinder includes at least one dovetail groove formed on the circumference thereof and a leg portion of said ceramic segment is dovetail shaped and axially slidably fitted in said dovetail groove on the circumference of said outer cylinder.

8. A guide roll as set forth in claim 1, further comprising a pair of juxtaposed partial guide rolls each being provided with said ceramic sleeve of discrete ceramic segments and respectively journalled in bearings at the opposite ends thereof to provide a guide roll of intermediate support construction.

9. A guide roll as set forth in claim 1, wherein said guide roll comprises a heat resistant guide roll.

10. A guide roll as set forth in claim 1, wherein said ceramic segments further comprise a first and second plurality of ceramic segments wherein said second plurality of ceramic segments include radially lateral projections extending therefrom wherein said first plurality of ceramic segments are engageable with said lateral projections of said second plurality of ceramic segments.

11. A guide roll having a ceramic sleeve around a circumference of a steel roll shaft with an internal cooling water passage formed therein, said guide roll comprising:

a cylindrical ceramic sleeve including a plurality of discrete ceramic segments forming a plurality of annular rings;

means for unitarily and individually fitting each of said rings around said circumference and along the length of said roll shaft such that said ceramic segments are each restricted at least in radial and circumferential directions of said roll shaft; and first and second end plates securely fixed to opposite ends of said roll shaft for holding said rings in position on the circumference of said roll shaft wherein said ceramic segments each include a radial hole formed therein and radially lateral projections on opposite sides thereof in staggered upper and lower positions and further comprising a bolt threaded into the circumference of said roll shaft through said axial hole in each of said ceramic segments.

12. A guide roll having a ceramic sleeve around a circumference of a steel roll shaft with an internal cooling water passage formed therein, said guide roll comprising:

a cylindrical ceramic sleeve including a plurality of discrete ceramic segments forming a plurality of annular rings;

means for unitarily and individually fitting each of said rings around said circumference and along the length of said roll shaft such that said ceramic segments are each restricted at least in radial and circumferential directions of said roll shaft; and first and second end plates securely fixed to opposite ends of said roll shaft for holding said rings in position on the circumference of said roll shaft wherein each of said rings further comprise a first ceramic segment with wing-like lateral projections in upper portions thereof and a second ceramic segment with wing-like lateral projections in a lower portion thereof, said first ceramic segments of each ring having radial holes formed therein and further comprising a plurality of bolts received in said holes in the respective first ceramic segments for securely fixing said first ceramic segments onto the circumference of said roll shaft, in such a manner as to restrict the second ceramic segments from movement in the circumferential direction.

13. A guide roll having a ceramic sleeve around a circumference of a steel roll shaft with an internal cooling water passage formed therein, said guide roll comprising:

a cylindrical ceramic sleeve including a plurality of discrete ceramic segments forming a plurality of annular rings;

means for unitarily and individually fitting each of said rings around said circumference and along the length of said roll shaft such that said ceramic segments are each restricted at least in radial and circumferential directions of said roll shaft; and first and second end plates securely fixed to opposite ends of said roll shaft for holding said rings in position on the circumference of said roll shaft wherein each of said ceramic segments include radial holes formed therein and include inclined lateral side surfaces and further comprising a plurality of bolts received in said holes for securely fixing said ceramic segments on the circumference of said roll shaft.

14. A guide roll having a ceramic sleeve around a circumference of a steel roll shaft with an internal cooling water passage formed therein, said guide roll comprising:

a cylindrical ceramic sleeve including a plurality of discrete ceramic segments forming a plurality of annular rings;

means for unitarily and individually fitting each of said rings around said circumference and along the length of said roll shaft such that said ceramic segments are each restricted at least in radial and circumferential directions of said roll shaft; and first and second end plates securely fixed to opposite ends of said roll shaft for holding said rings in position on the circumference of said roll shaft further comprising a plurality of mounting strips of I-shape in section and a plurality of support rings fitted on the circumference of said roll shaft and said mounting strips, wherein said rings further comprise a first ceramic segment and a second ceramic segment, the ceramic segments of the respective rings being aligned and abutted in the axial direction through said support rings fitted on the circumference of said roll shaft in contact with inner portions of the abutted end faces of said ceramic segments, said second ceramic segments having an axial groove formed on a bottom side thereof and being axially connected with each other and fixed in position on the circumference of said roll shaft by said mounting strips of I-shape in section, said strips having upper and lower halves thereof slidably fitted in said axial grooves of complementary shape formed on the bottom side of said second ceramic segments and on the circumference of said outer cylinder of said guide roll in such a manner as to restrict said first ceramic segments in the circumferential direction.

* * * * *